United States Patent [19]

Jacobson et al.

[11] 4,127,243

[45] Nov. 28, 1978

[54] DEVICE FOR A MISSILE OR THE LIKE

[75] Inventors: Gunnar Jacobson; Per-Erik Jarnholt; Erik H. Lindholm; Olof B. Olsson, all of Karlskoga, Sweden

[73] Assignee: Aktiebolaget Bofors, Bofors, Sweden

[21] Appl. No.: 777,274

[22] Filed: Mar. 14, 1977

[30] Foreign Application Priority Data

Apr. 2, 1976 [SE] Sweden ..... 7603927

[51] Int. Cl.[2] ..... F42B 15/00

[52] U.S. Cl. ..... 244/3.21; 60/253; 102/49.3

[58] Field of Search ..... 60/253–256, 60/271; 102/49.3–49.8; 244/3.1, 3.21, 3.22

[56] References Cited

U.S. PATENT DOCUMENTS

| | | | |
|---|---|---|---|
| 1,879,579 | 9/1932 | Stolfa et al. | 60/253 |
| 2,489,953 | 11/1949 | Burney | 102/49.7 |
| 2,816,721 | 12/1957 | Taylor | 244/3.21 |
| 3,013,494 | 12/1961 | Chanut | 244/3.21 |

*Primary Examiner*—Verlin R. Pendegrass
*Attorney, Agent, or Firm*—Pollock, Vande Sande & Priddy

[57] ABSTRACT

In a missile assembly (or the like) including a motor nozzle positioned in a central portion of a rear surface of the missile and a sustainer motor positioned a distance away from the rear surface of the missile, the invention comprising a blow pipe joining the sustainer motor and nozzle assembly, with the blow pipe including a portion extending along an axis which is eccentrically positioned with respect to the longitudinal axis of the missile.

8 Claims, 2 Drawing Figures

DEVICE FOR A MISSILE OR THE LIKE

BACKGROUND OF THE INVENTION

The present invention relates to a device for a missile (or the like) which comprises a sustainer motor located at a distance from a rear surface of the missile, a motor nozzle arranged centrally in the rear surface, and a blow pipe which extends between the sustainer motor and the motor nozzle.

For defense purposes, enemy targets are often attached with the aid of guided projectiles or missiles. For example, such missiles may have a range of less than 5 km, and are generally quite small in size, with a diameter of between 100 and 150 mm. Known missile assemblies of this type usually include the following missile structure: wings, warhead, sustainer motor, gyroscope, battery, electronics, control members in the form of nozzle control members, and signal receiver or wire spool and tracer. When using nozzle control members, it is desirable to position the nozzle of the sustainer motor in a central portion of the rear surface of the missile. For the missile to maintain a stable movement during its trajectory, while also remaining easy to control, the aerodynamic centre of pressure must be behind and relatively near the centre of gravity of the missile. This requires the stabilization wings to be located in the vicinity of the centre of gravity of the missile. For the centre of gravity of the missile to remain fixed even after a powder charge of the propellant motor burns up, the powder charge of the propellant motor should also be located in the missile in such a way that the centre of gravity of the powder motor is near or coincides with the resulting centre of gravity of the missile. These two requirements, both of which must be fulfilled simultaneously, require the stabilization wings of the missile and the powder charge of the propellant motor to be located in the same portion of the missile, which is usually the middle portion. Certain apparatus, such as a warhead may be placed forwardly of the propellant motor, while other apparatus should be positioned between the propellant motor and the rear surface for proper functioning. Among such rearwardly positioned apparatus or components are the signal receiver or wire spool, and the nozzle control members and the tracers.

Assuming the wings of the missile, the propellant motor, warhead, nozzle control members, tracer and signal receiver are located in such a way that the resulting centre of gravity will be in the middle of the propellant charge, the conclusion arises that the remaining apparatus, including the gyro, electronics and battery must be located somewhere between the rear end of the propellant motor and the rear surface of the missile. However, in this space, a blow pipe extends from the rear end of the sustainer motor to the rocket motor nozzle, and if this pipe were to be arranged centrally through a longitudinal axis of the missile, the space available for the gyro, electronics and battery will be a ring-formed space between the centrally positioned tube and the inner surface of the missile body. If the outer dimension of the blow pipe, including its insulation, is assumed to have a diameter of 25 mm, the space for the gyro, electronics and battery will have a minimum dimension of 30–35 mm. While it is possible to design the electronics assembly and the battery so that there will be sufficient room for them in such a space, it is considerably more difficult to make room for a gyroscope in the remaining space, which is limited from a radial point of view. The miniature gyroscopes available in the market usually have a minimum diameter of between 50 and 60 mm. It is possible, of course, to design gyroscopes which can be installed in the ring-formed space available, but the costs of such a gyroscope will be many times greater than the costs of conventional miniature gyroscopes. In order to solve this problem, it has hitherto been proposed to over-dimension the missile from the point of view of the diameter, which, however, also involves increased costs.

SUMMARY OF THE INVENTION

A purpose of the present invention is to create a device which solves the problems involved in making room for a conventional gyroscope or like assembly in a missile of optimally small diameter. A novel feature of the new device is that the blow pipe includes a first section extending from the motor which is essentially parallel to and is eccentrically positioned a substantial distance from the longitudinal axis of the missile. An attached rear portion of the blow pipe includes a second section with two bends which provide for connection to the motor nozzle which is located centrally in the rear surface of the missile.

BRIEF DESCRIPTION OF THE DRAWINGS

An embodiment of the present invention will be described in the following, with reference to the accompanying drawings, in which.

DETAILED DESCRIPTION OF THE PREFERRED EMBODIMENT

Figure 1:
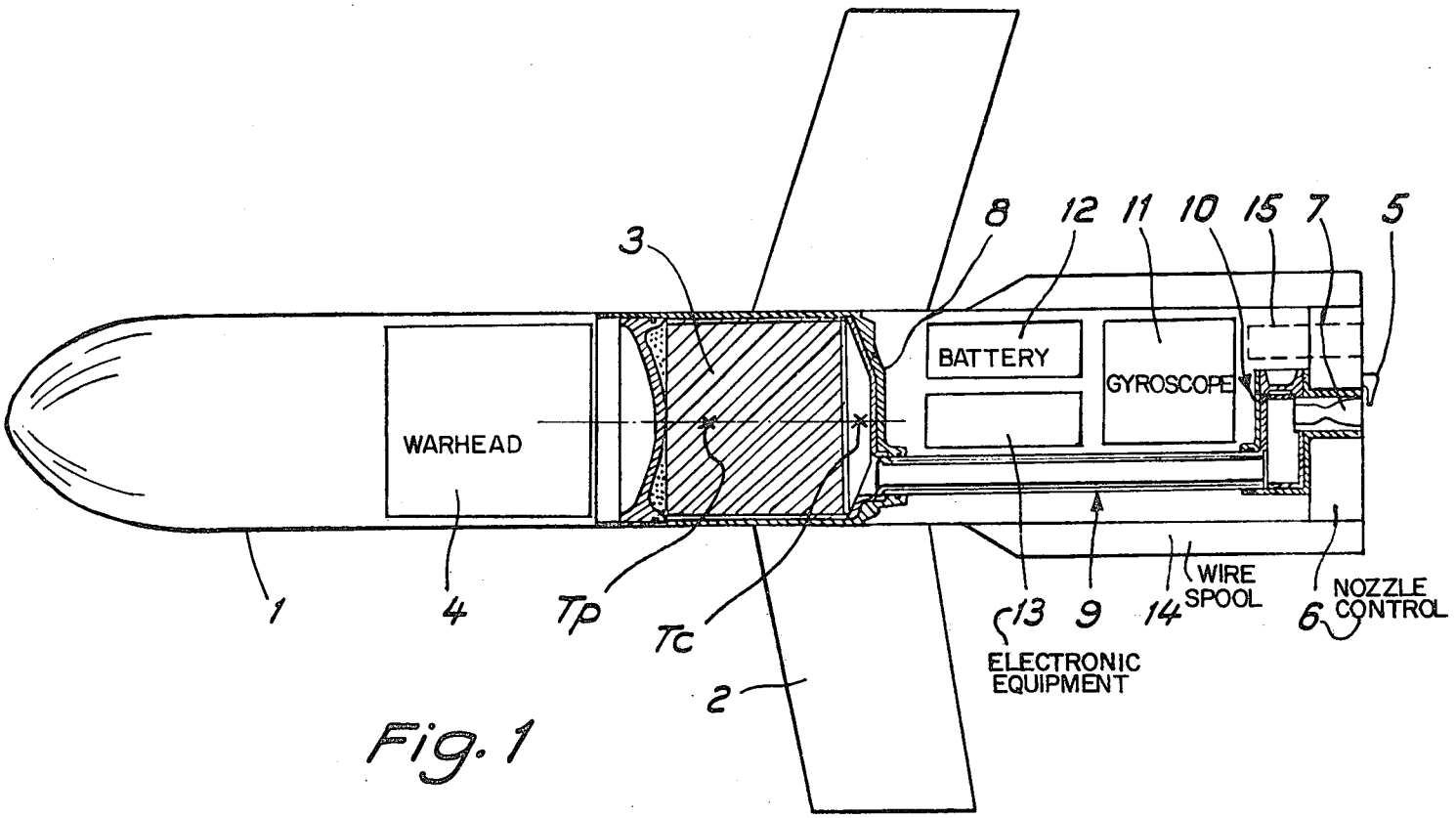
FIG. 1 shows a longitudinal section of a missile utilizing a preferred embodiment of the invention.

In FIG. 1, the body structure of the missile is designated by the numeral 1, and the wings of the missile, only two of which are shown in the figure, are designated 2. In the middle portion of the missile a propellant motor or sustainer motor 3 of the powder rocket motor type is arranged. A warhead 4 is positioned in front of the propellant motor. The missile also includes one or more nozzle spoilers 5, arranged at the rear surface of the missile, which influence the propellant gas jet emitted centrally from the rear surface of the missile in response to controls from the nozzle control member which is symbolized at 6 and is placed in a unit which forms the rear end wall of the missile. In the centre of the end wall, a nozzle 7 is placed for connection with the propellant motor 3. Between the rear section 8 of the propellant motor 3 and the motor nozzle 7 is a blow pipe which includes a first section 9 and a second section 10 attached in a way described in more detail in the following. The first section 9 is eccentrically positioned in the space between the rear parts of the motor 3 and the rear parts of the missile. The space also includes a gyroscope 11 of a conventional type requiring radial space, as well as a battery 12 and electronic equipment 13. On the outside of a partition of the missile and behind the wings 2 there is also a wire spool 14. A tracer is designated 15.

Apart from the special arrangement of the blow pipe 9, 10, the remaining components are each of conventional construction, and the arrangement of the components requires the centre of gravity of the missile to be located at a point indicated $T_p$, while its centre of pressure is located rearwardly of centre of gravity, at $T_c$.

Figure 2:
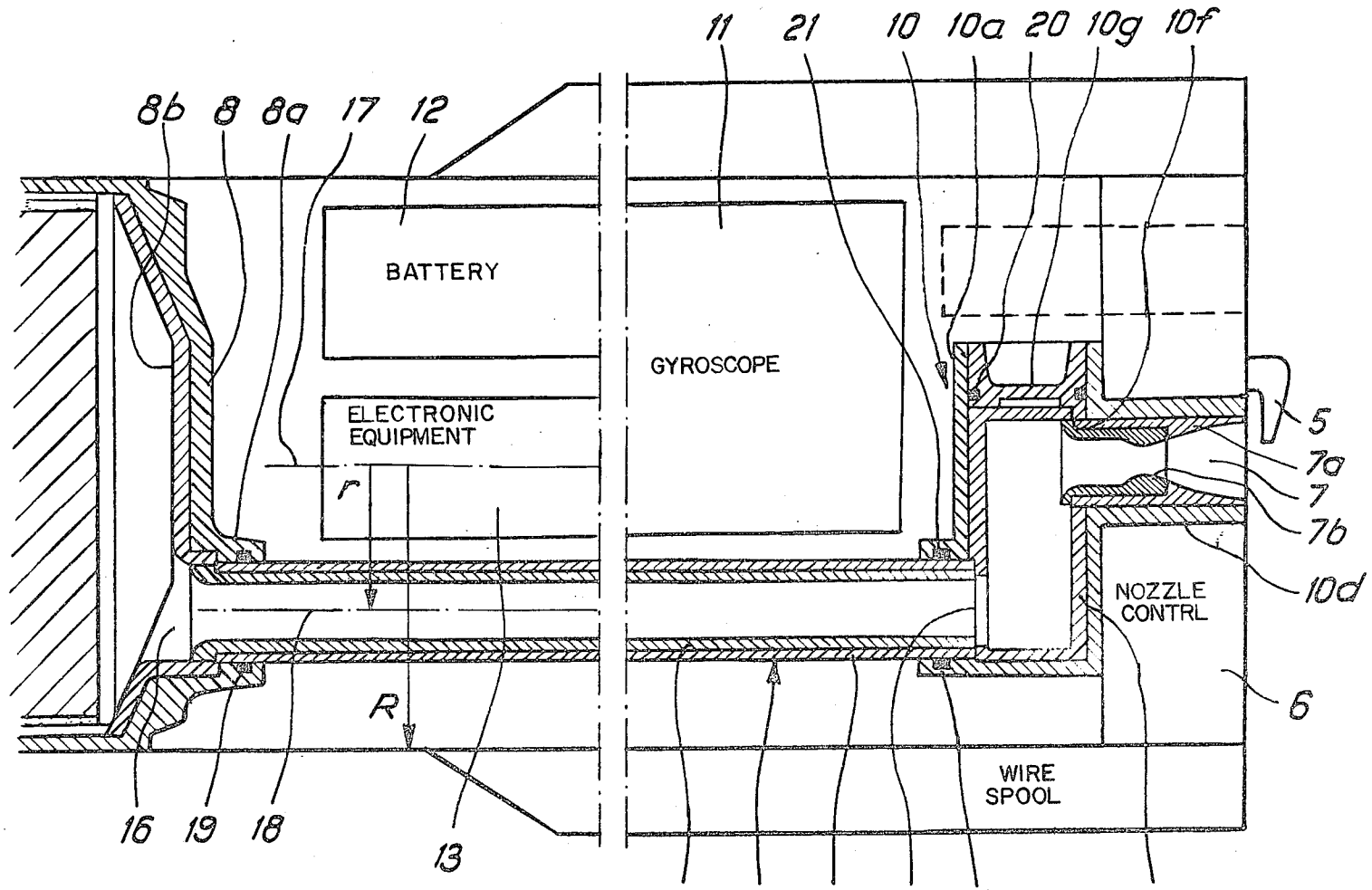
FIG. 2 shows a longitudinal enlarged section of the embodiment according to FIG. 1.

As shown in FIG. 2, a recess 16 in the rear end 8 of the propellant motor is arranged for connection with the blow pipe 9, which extends eccentrically in relation to the longitudinal axis 17 of the missile. From said recess 16, said first section 9 extends in the form of a straight, first pipe part rearwardly and parallel to the axis 17 of the missile. The longitudinal axis 18 of the first pipe part is moreover arranged at a radial distance *r* which in the embodiment shown is approximately one half of the radius R of the internal space in the missile at the part of the missile in question. The relation between the distances *r* and R constitute an ideal case, but it may be varied in dependence on, among other things, the total outer diameter of the blow pipe. In all, the distance *r* should be 0.2–0.8 of the distance R. In principle, however, the first pipe part 9 can be arranged close to the inside of the hull of the missile.

The first pipe part 9*a* extending has insulation 9*b* internally therein. At its front or forward end, the first pipe part 9*a* is sealed against the outlet flange 8*a* via a seal 19, which prevents leakage of propellant gas. The insulation 9*b* of the tube is positioned for connection with insulation 8*b* applied on the inner wall of the rear section 8.

The second section 10 of the blow pipe comprises a straight second pipe part 10*a* which extends substantially at right angles to the longitudinal axis 18 of the first pipe part. Also the second part 10*a* has insulation extending internally thereto, which in the present embodiment is designated 10*b*. The second pipe part 10*a* is made with a first tubular recess 10*c*, into which the straight first pipe part 9*a* extends and is supported with its rear end, and a second tubular recess 10*d*, in which the motor nozzle 7 is supported.

At the first recess 10*c*, the insulation of the second pipe part 10*b* is provided with a first recess 10*e*, which permits gas to flow into the second pipe part 10*a* and to the motor nozzle 7. At the second recess 10*d* the insulation of the second pipe part 10*b* is provided with a second recess 10*f* for the motor nozzle 7. The second pipe part 10*a* is provided with a cover 10*g* which is sealed against the inner wall of the pipe 10*a* via a sealing ring 20. The second pipe part 10*a* is fastened to the wall formed by the unit 6. The cover 10*g* provides for partial insulation of the second tube and the parts of the motor nozzle 7. The first pipe part 9*a* is sealed in the corresponding way against the recess 10*c* of the second pipe part via a sealing ring 21. The motor nozzle 7 has an outer part 7*a* made of metal and an inner part 7*b* made of graphite. The insulation of the second pipe part 10*b* is adapted to said inner part 7*b*.

In the present embodiment, connection of the first pipe part 9*a* to the motor nozzle 7 is obtained via two 90° bends, the configuration of which, however, can be varied. The material in the blow pipe sections and the insulation for these and the arrangement shown of the embodiment of the blow pipe parts allows the flow and heat problems arising in the blow pipe to be solved. It should then be noted that the temperature of the gas conducted in the blow pipe has values of approx. 2000° C., and that the gas velocity can be in the magnitude of 20% of sonic speed and higher. The material of the pipe parts 9*a* and 10*a* may consist of special steel or light metal alloys which are known in themselves, and the same applies to the insulations which may comprise asbestos filling and the like.

The inner diameter of the missile surround in the space in question may vary between 100 and 150 mm, and the first pipe part with insulation may have an external diameter of approx. 25 mm.

The blow pipe arrangement shown is also intended to provide for efficient manufacturing processes for the missile itself. The material in the rear end of the motor and its insulation also may comprise of conventional materials.

The invention is not limited to the embodiment shown above as an example, but can be subject to modifications within the scope of the following claims.

We claim:

1. A device for a guided projectile which comprises: a sustainer motor located at a distance from a rear surface of the projectile, a motor nozzle arranged centrally in the rear surface, and a blow pipe which extends between the sustainer motor and said nozzle, with the blow pipe extending eccentrically from the sustainer motor and including a first section which is essentially parallel to and located at a substantial distance from a longitudinal axis of the projectile and at a rear portion of the projectile the blow pipe includes a second section formed with two bends which provide for connection to the motor nozzle which is located centrally in the rear surface of the projectile, room then being provided for apparatus and/or components for which space is required radially notwithstanding a comparatively limited diameter of the projectile.

2. A device according to claim 1, wherein the bends in the second section are 90° bends.

3. A device according to claim 1, wherein the first pipe section comprises a first straight pipe part and the second section comprises a straight second pipe part which extends at right angles in relation to the first pipe part and parallel to the rear surface, with the second pipe part having a first end made with a first recess to which the first pipe part is connected at its rear end, that the second pipe part at its second end having a second recess in which the motor nozzle is arranged, and the second pipe having a further recess provided with a cover.

4. A device according to claim 3, wherein the longitudinal axis of the first pipe part is located at a radial distance (r) from the longitudinal axis of the projectile which is within the range of 0.2–0.8 of the inner radius (R) of the projectile, and particularly is approx. 0.5 of said inner radius.

5. A hollow, guided projectile adaptable for delivering a warhead against a target, and comprising:

a propellant motor assembly located at the center of gravity of the projectile;

a recess formed in a wall of said propellant motor, said recess being eccentrically positioned with respect to the longitudinal axis of said projectile;

a tubular assembly connecting with said recess and extending parallel to the longitudinal axis;

a nozzle assembly positioned within a recess formed in a central portion of the rear surface; and means for joining an end of said tubular assembly with said nozzle assembly.

6. An apparatus according to claim 5, wherein said tubular assembly comprises a longitudinally extending pipe which is sealingly connected to said recess leading to the propellant motor;

said tubular assembly further comprising a tubular insulation member positioned within said pipe for insulating said pipe against propulsive gases emitted by said propellant motor.

7. An apparatus according to claim 5, wherein said means comprises a hollow connection assembly generally extending at a right angle to said tubular assembly, said connection assembly comrpising a first recess sealingly connecting with said tubular assembly and a second recess connecting with said motor nozzle.

8. An apparatus according to claim 7, wherein said connection assembly further includes an insulation member positioned within said hollow connection member for insulating said connection member against the propulsive gases passing therethrough.

* * * * *